US005569082A

United States Patent [19]

Kaye

[11] Patent Number: 5,569,082

[45] Date of Patent: Oct. 29, 1996

[54] PERSONAL COMPUTER LOTTERY GAME

[76] Inventor: Perry Kaye, 6446 Lupton Dr., Dallas, Tex. 75225

[21] Appl. No.: 418,011

[22] Filed: Apr. 6, 1995

[51] Int. Cl.[6] ..... A63F 1/00; A63B 71/00

[52] U.S. Cl. ..... 463/17; 463/16; 463/13; 463/12; 463/29; 273/139; 283/901; 283/903; 364/412

[58] Field of Search ..... 364/410, 412; 273/138 R, 138 A, 139, 433–434, DIG. 28; 463/13, 12, 16–20, 29–31, 36–38; 283/49, 70–71, 901, 903

[56] References Cited

U.S. PATENT DOCUMENTS

| | | | |
|---|---|---|---|
| 4,108,361 | 8/1978 | Krause | 364/412 |
| 4,288,077 | 9/1981 | Rose et al. | 273/138 R |
| 4,575,622 | 3/1986 | Pellegrini | 364/410 |
| 4,582,324 | 4/1986 | Koza et al. | 273/138 A |
| 4,652,998 | 3/1987 | Koza et al. | 364/412 |
| 4,689,742 | 8/1987 | Troy et al. | 273/138 A |
| 4,760,247 | 7/1988 | Keane et al. | 364/412 |
| 4,764,666 | 8/1988 | Bergeron | 273/139 |
| 4,832,341 | 5/1989 | Muller et al. | 273/138 A |
| 4,882,473 | 11/1989 | Bergeron et al. | 235/380 |
| 4,996,705 | 2/1991 | Entenmann | 364/412 |
| 5,069,453 | 12/1991 | Koza et al. | 273/139 |
| 5,083,272 | 1/1992 | Walker et al. | 364/412 |
| 5,112,050 | 5/1992 | Koza et al. | 273/139 |
| 5,212,368 | 5/1993 | Hara | 235/375 |
| 5,223,698 | 6/1993 | Kapur | 364/412 |
| 5,282,620 | 2/1994 | Keesee | 273/138 A |
| 5,326,104 | 7/1994 | Pease et al. | 273/138 A |
| 5,327,485 | 7/1994 | Leaden | 379/95 |
| 5,330,185 | 7/1994 | Wells | 364/412 |
| 5,331,141 | 7/1994 | Kaneko | 235/462 |
| 5,342,047 | 8/1994 | Heidel et al. | 273/138 A |
| 5,348,299 | 9/1994 | Clapper, Jr. | 273/138 A |
| 5,365,575 | 11/1994 | Katz | 379/92 |
| 5,377,975 | 1/1995 | Clapper, Jr. | 273/138 A |
| 5,398,932 | 3/1995 | Eberhardt et al. | 273/138 A |
| 5,407,199 | 4/1995 | Gumina | 273/138 R |
| 5,411,258 | 5/1995 | Wilson et al. | 364/410 |
| 5,415,416 | 5/1995 | Seagnelli et al. | 273/138 A |
| 5,417,424 | 5/1995 | Snowden et al. | 364/412 |
| 5,429,361 | 7/1995 | Raven et al. | 273/138 A |

*Primary Examiner*—Sebastiano Passaniti
*Assistant Examiner*—Mark A. Sager
*Attorney, Agent, or Firm*—Ross, Clapp, Korn & Montgomery, L.L.P.

[57] ABSTRACT

A method and system for playing a player interactive lottery type game includes a gaming piece which includes a predetermined code having data indicating whether the player wins or loses the game, the data being unrecognizable to the player, such that the player does not know the outcome of the game prior to play of the game. The code is entered by the player into a processor. The processor presents a game of chance to the player on a display for interactive play by the player, and the player controls game play by inputting game parameters to the processor. The processor controls the outcome of the game of chance played by the player based upon the code entered by the player. A display provides an indication to the player of a game win or a game loss based upon the code.

17 Claims, 10 Drawing Sheets

PERSONAL COMPUTER LOTTERY GAME

TECHNICAL FIELD OF THE INVENTION

The present invention relates to personal computers, and more particularly to an interactive lottery/casino type game which allows players to purchase game tickets in the form of data storage media to be used in a personal computer.

BACKGROUND OF THE INVENTION

The present invention relates to a system for the administrating, operating, and playing of a game in which a player acquires a chance to win and the outcome of that chance is displayed in an interesting, fun, and exciting fashion.

An important application of the invention is in the operating of games of chance in which a person purchases a chance to win and then learns of the outcome in an interesting and fun fashion. Some of these games are usually called lotteries or raffles. The operation and running of these games entails the purchase of a chance to win and then at some point a single and usually quick action displays the outcome of the game.

As an example, the playing of what is called a scratch off lottery is as follows. A player purchases a chance to win in the form of a card having symbols and a covered area that conceals the outcome of the game. In this type of game the odds of winning are controlled by the number and type of cards that are created. The player scratches the coating that covers the concealed area which reveals the game's outcome by the symbols or words that are under the coating. This activity provides the player with just a brief few moments of excitement.

Problems are inherent in the current gaming systems arising from: (a) the low level of excitement that is generated from the display of the games outcome; (b) the fact that it takes just a few moments to play the game; (c) insufficient player interaction with the game except for boring scratching of the coating; (d) excessive space that is required to store the different games necessary to stock all of the available printed game cards; (e) tracking and control of the game cards; (f) non-challenging simple games; (g) dirt caused by the scratched coating; (h) the limited number of games because the only variations to the game are the use of different symbols, colors, or placement of the symbols; (i) fraud caused by game card theft and/or tampering; (j) waste caused by the need to print and stock many different game card to keep players interested; (k) restricting access to minors; and (l) allowing for system wide and regional control and monitoring.

There are many ways in which these problems are overcome by the present invention and there are many new ways to apply this invention to create new and exciting games.

Players want a game that has variety, excitement, a multi-sensory game display, which provides players with options and choices. Game operators want a game that has controllable odds, is simple to run and administer, will increase their sales, help eliminate fraud, and control their inventory.

Bearing these facts in mind it is considered that any improved design of such a game should incorporate the principle of allowing a player to acquire at least one chance to win, in a game of chance, and then provide an exciting and interesting display for the outcome of that chance. The display method would be even more interesting if it were player selectable and if many companies could participate in the creation of the games that display the outcome.

A need has thus arisen for a system for administrating and operating a game that overcomes some of the problems associated with known systems.

SUMMARY OF THE INVENTION

In accordance with the present invention, a method and system for playing a player interactive lottery type game is provided. The player acquires a gaming piece which includes a predetermined code having data indicating whether the player wins or loses the game, the data being unrecognizable to the player, such that the player does not know the outcome of the game prior to play of the game. The code is entered by the player into a processor. The processor presents a game of chance to the player on a display for interactive play by the player, and the player controls game play by inputting game parameters to the processor. The processor controls the outcome of the game of chance played by the player based upon the code entered by the player. A display provides an indication to the player of a game win or a game loss based upon the code.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
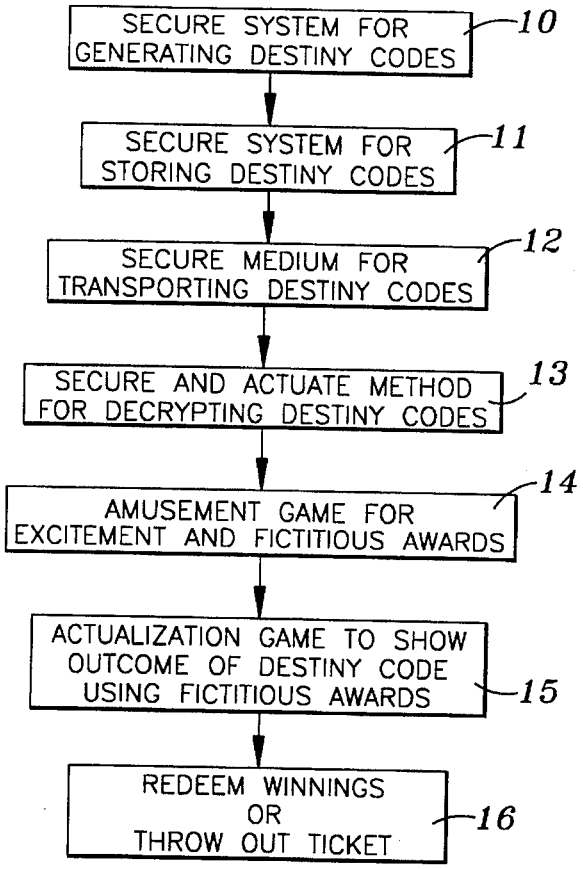
FIG. 1 is a block diagram of the basic components of the present game.

FIG. 1 is a block diagram of the basic components of the present system. Block 10 shows that the start of the system requires a secure system for generating and controlling and tracking encrypted symbolic codes that signify the outcome of the particular game of chance to be played by the player. These codes are called "Destiny Codes" because their primary function is to store the outcome of the game of chance. The codes can, in addition, store other data that assists in the playing of the game, the tracking of the game, the security of the game, or any other data that may enhance the game or its operation. If the player knew the procedure to decode the Destiny Code, the player would be able to determine if the Destiny Code contained a winning chance or a losing chance. The total and actual result of the game is encoded in the Destiny Code. By decoding the Destiny Code one reveals whether or not a game was a winner or a loser, and if it was a winner, the prize won.

The system for generating the Destiny Codes stores the codes on a secure medium called the Game Medium. The process of storing the Destiny Codes on the Game Medium is identified in block 11, and the Game Medium is signified in block 12. The process of storing the Destiny Codes on the Game Medium depends on the type of Game Medium used. If, for example, the Game Medium is paper, then the storing of the Destiny Codes is through printing. If the Game Medium is a computer then the storage of the Destiny Codes includes magnetic or laser techniques. The Game Medium allows for the storing of several Destiny Codes. Security can be added to provide a deterrent to theft and fraud.

Once a Destiny Code is generated and stored, a player can acquire that Destiny Code and use the code in the play of a game. Because the Destiny Code stores the actual outcome of the game, the code must be processed to discover how the game should play. Block 13 indicates the step of decrypting and decoding of a Destiny Code.

Using the code, a player is now allowed to play an amusement game signified by block 14. The game can be a completely random game where the player achieves points or awards. The game is purely for player enjoyment, and is used to give the feel of a completely random game of chance. One example of the game is a horse race in which the player is given a predetermined number of dollars to bet. At some point, either at the discretion of the player or the necessity of the game (all races have been run or the player has run out of money), the amusement game comes to an end.

The system now begins the playing of the actual game which is shown in block 15. The purpose of the actual game is to display, in a pleasing fashion, the actual prize that is stored in the Destiny Code and to display the game results as though there is a completely random element. One example of how the actual game interfaces with the horse race game is as follows. In this example the actual game is a lottery. The player could use the winnings from the horse race game to purchase fictitious lottery tickets. The player can have the computer select the tickets or the player can select the tickets. If the player is out of money the system will award one lottery ticket to the player.

At this point the actualization game determines the outcome of this game by using the Destiny Code. If the Destiny Code indicates the player is to win $25.00, then the system will select and display numbers that match the player's fictitious lottery tickets in a combination that wins the person $25.00. If the Destiny Code indicates that the player is to lose, then the system will select and display numbers that do not match the player's fictitious lottery tickets so the player will view a losing game.

For example, assume the actual game requires three numbers to match to win $25.00, and the player has two lottery tickets. The first ticket contains the numbers 1, 2, 3, 4, 5, 6 and the second contains the numbers 20, 21, 22, 23, 24, 25. If the Destiny Code states that the player should win $25.00, the actualization game will select a set of numbers that make the player win the $25.00 actual prize. The actualization game displays, in a pleasing and seemingly random fashion, numbers being picked. The winning lottery numbers 21, 30, 6, 23, 24, 4 match three numbers from the second lottery ticket (21, 23, 24) and not enough numbers (you must have at least 3 to win) from the first ticket to cause the first ticket to win.

If the Destiny Code indicates that the player should not win, then the actualization game will select a set of numbers that do not create a winning combination from any of the lottery tickets, for example, the numbers 1, 2, 20, 21, 50, 60, or 51, 52, 53, 54, 55, 0.

The games of block 14 and block 15 can be run as one system, such as a poker game. The amusement/ actualization game receives the Destiny Code which then sets up the game as a win or lose. The system displays a deck of cards and a display key that shows the jackpots and winning rules. The key could illustrate 1 Pair=$10.00, 3 Of A Kind=$15.00, 2 Pair=$20.00, a Straight =$50.00 and a Royal Flush= $100.00. The system shows five cards to the player, for example, a 10, Jack, 4, 6, and an 8. The player discards the 4, 6, 8 and the system, depending on the Destiny Code, will display cards that provide a winning or losing hand. If the code indicates the player is to win $10.00, cards 10, 2, and 4 may be dealt, so the player will have 10, 10, Jack, 2, 4. Two tens, 1 Pair, wins $10.00. The rules of the game will be set up in such a way so the Destiny Code can have full control and freedom to display the actual outcome of the game.

If the above example was destined to be a loser then cards such as 2, 3, 4 could have been dealt.

Block 16 indicates redeeming the winnings. A player brings the game medium to a redemption and verification system to verify the validity of the game medium and the Destiny Code and payout the winnings to the player or reject the card as a loser.

Figure 2:
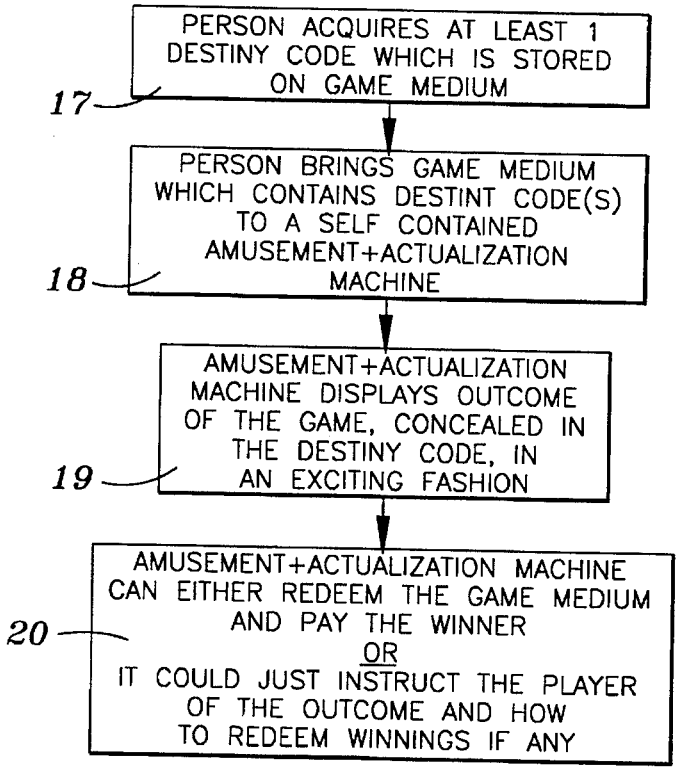
FIG. 2 is a block diagram of the basic steps of the self-contained embodiment of the present game.

FIG. 2 is a block diagram of the basic components of the Self-Contained Amusement/Actualization embodiment of the present game. This system allows a player to acquire a game medium with at least one Destiny Code in order for a player to play an exciting game and discover the outcome of the game without human intervention.

Block 17 signifies the acquisition of a game medium. Acquisition can be in any form, for example, a purchase from a salesperson or an Automated Destiny Code Machine shown in FIG. 4. The game medium includes one or more stored Destiny Codes.

A player wishing to purchase Destiny Codes reads the instructions on the instruction touch screen 33 of a sales device (FIG. 4) and enters answers to questions such as "how many tickets do you want to buy?" Money is put into a bill validater 34. A game medium reader/writer 35 creates a new game medium or adds new Destiny Codes to an existing game medium. The sales device can have predetermined Destiny Codes stored in it or it could be connected on-line and act as a Destiny Code terminal similar to a bank ATM. This allows many sales devices (FIG. 4) to give Destiny Codes under the control of a single organization and through a single computer or network.

Figure 5:
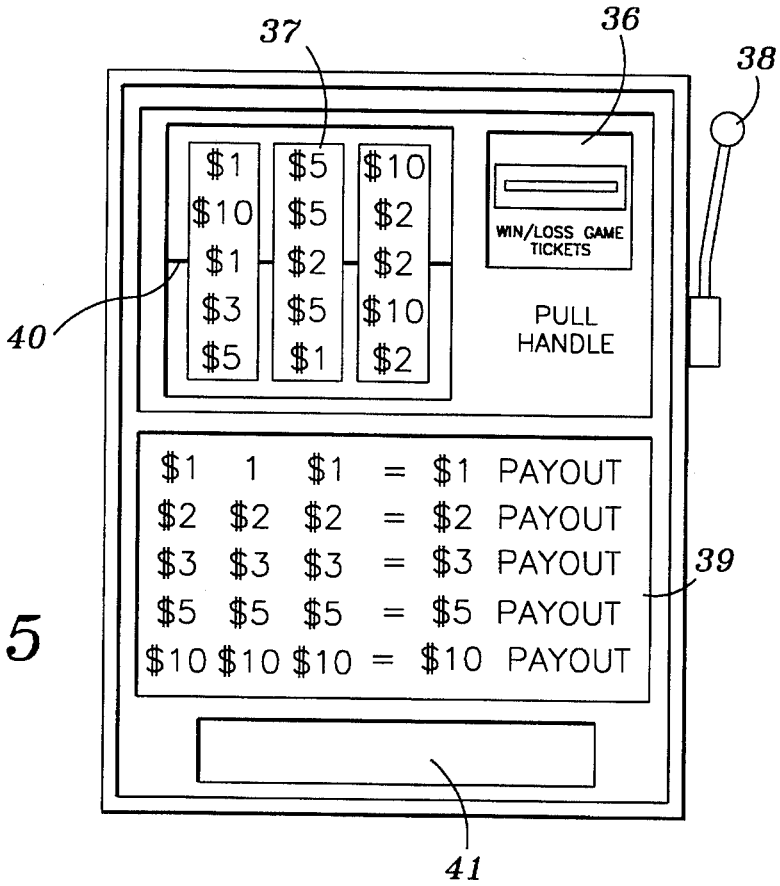
FIG. 5 illustrates a display device for the self-contained embodiment of the present game.

Players bring the game medium, in block 18 (FIG. 2) to a self-contained amusement+actualization device shown in FIG. 5 and allows the game medium reader/writer 36 to read the Destiny Codes from the game medium. The self-contained amusement+actualization device then reads in any order or in a sequential fashion, the Destiny Codes. If a Destiny Code has not been used, the device will allow the person to play the game to discover the outcome concealed in the Destiny Code. FIG. 5 illustrates a slot type machine.

At block 19 (FIG. 2) the player pulls the handle 38 (FIG. 5), and the reels on the screen 37 spin and stop in an order that shows the outcome indicated by the Destiny Code. FIG. 5 illustrates display 37 displaying a losing combination, $1, $2, $2, on pay line 40. The key that shows which combinations are valid winners is displayed on the Game Instructions Screen 39. Screen 39 is a programmable screen that allows for the playing of any Destiny Codes possible winning combinations. Figure 5 illustrates screen 39 for a game in which the maximum Actual Prize is $10.00 as controlled by the Destiny Code. If the Destiny Code indicated that the actual prize might be as great at $1,000.00, the game instructions screen would dynamically display this information.

Now that the game has been played and a Destiny Code has been decrypted and decoded the game medium is marked by the game medium reader/writer 36 (FIG. 5) to show that that particular Destiny Code has been played. If the player won at block 20, the self-contained amusement+actualization device can either pay out the prize through the pay out slot 41 (FIG. 5) or the device will instruct the player of the outcome or redemption instructions on the game instruction screen 39. The game medium reader/writer 36 marks the game medium to show that the card contains a winner or loser and that the Destiny Code has been used.

Figure 4:
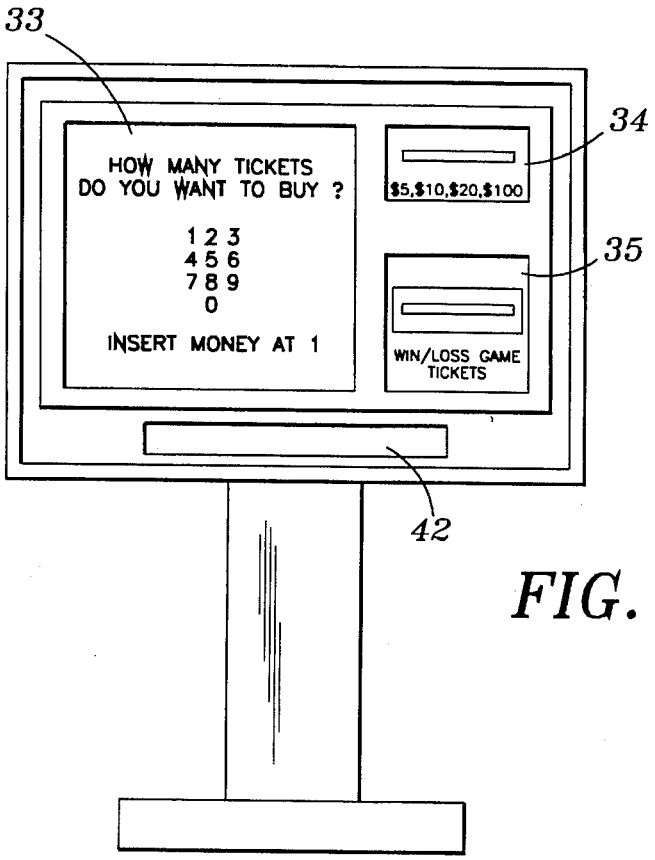
FIG. 4 illustrates a sales device used to purchase game media for the self-contained embodiment of the present game.

Redemption can also be accomplished at the automated Destiny Code machine, FIG. 4. A player allows the automated Destiny Code device (FIG. 4) to read the game medium at the game medium reader/writer 35. The instruction screen 33 will display instructions and information about the game medium and the stored Destiny Codes. Pay out can be received at the pay out slot 42.

Figure 3:
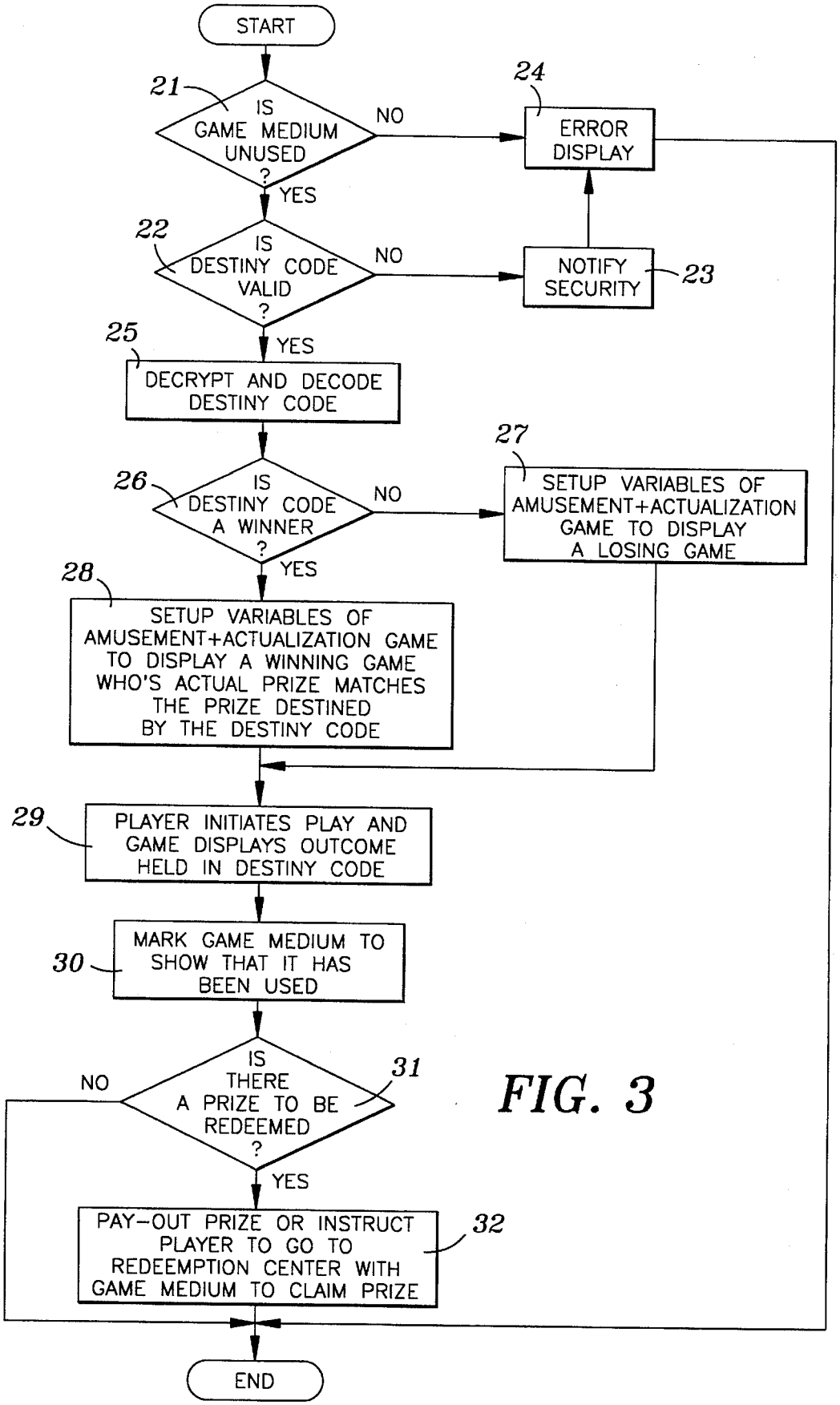
FIG. 3 is a computer flow chart illustrating operation of the self-contained embodiment of the present game.

Referring to FIG. 3, the self-contained amusement+actualization device program operates as follows. The system reads the game medium and checks to see if the game medium has been used at block 21. If the medium has been used, the amusement+actualization device displays an error at block 24 and exits. If the game medium has not been used, the program checks to see if the Destiny Code is valid at block 22. If the code is invalid, that is an indication of tampering or fraud, so the amusement+actualization device will notify security at block 23, display an error at display 24, and then exit.

If the Destiny code is valid at block 22 then the amusement+actualization device will decrypt the Destiny Code and decode the Destiny Code at block 25. This operation makes the Destiny Code readable. A determination is made at block 26 to see whether the Destiny Code indicates a win or loss.

If the Destiny Code is a loser then the system sets the variables of the game so that the game will display a losing outcome at block 27. If the Destiny Code is a winner then the system sets the variables of the game so that the game will display a winning outcome at block 28.

Player initiates play at block 29 and then the outcome of the Destiny Code is shown on the amusement+actualization display screen 37 (FIG. 5).

The game medium is marked at block 30 to show that that particular Destiny Code has been used.

If there is an Actual Prize to be redeemed at block 31, the system at block 32 either pays out the prize or instructs the player to take the game medium to a redemption location.

Figure 6:
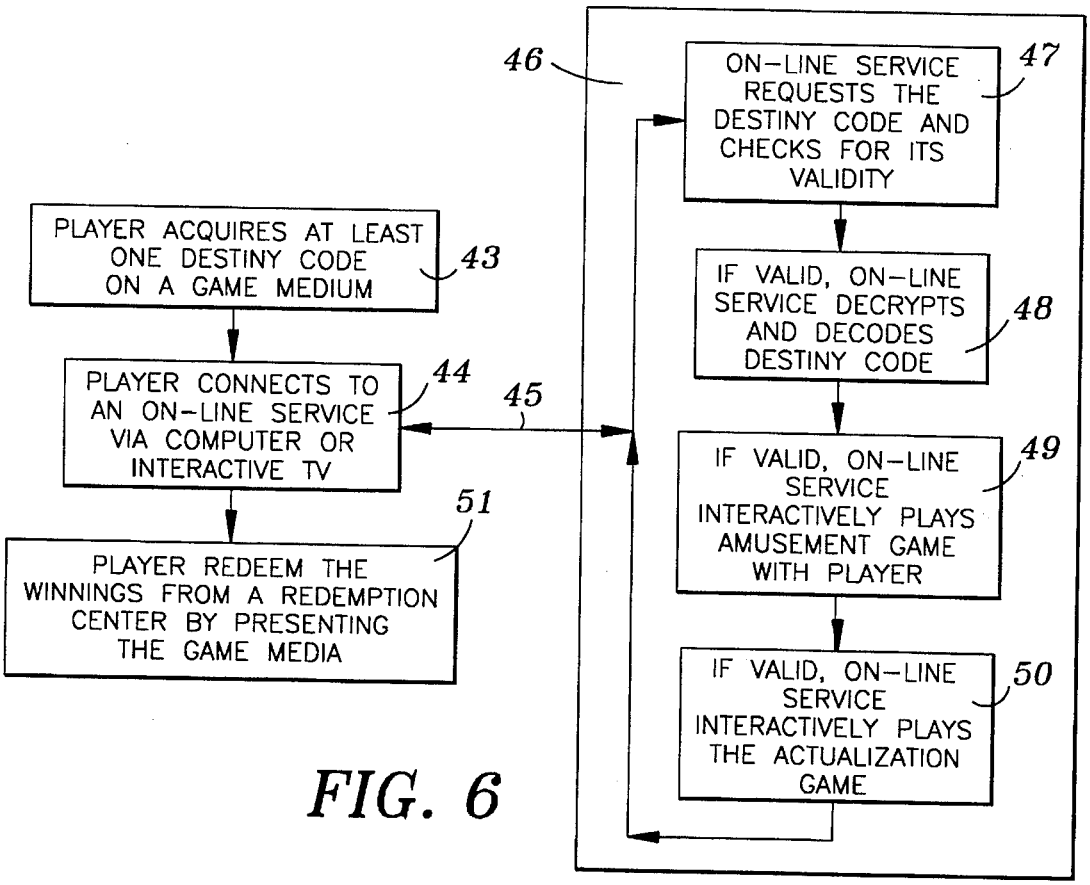
FIG. 6 illustrates a block diagram of the on-line embodiment of the present game.

FIG. 6 illustrates the on-line embodiment of the present game. The player acquires at least one Destiny Code on a game medium at block 43. The player brings the game medium to a home computer or an interactive TV system or some type of on-line service device at block 44 called the player's terminal. A connection is made at block 45 between the players terminal 44 and the on-line system block 46.

The on-line system 46 controls a game as shown in FIGS. 8–13. Block 46 indicates the basic components necessary for the implementation of the on-line use. The on-line system will request the player's Destiny Code at block 47 and then will check the Destiny Code for its validity.

If the Destiny Code is valid and un-played the online service will decrypt and decode the Destiny Code at block 48.

The on-line service now interactively plays an amusement game with the player at block 49. The player is awarded Fictitious Awards and plays until the player wishes to play the actualization game or until the games rules require.

The on-line service now interactively plays an actualization game with the Player at block 50. The actualization game uses the fictitious awards in a way that gives the appearance that the awards have a value in the actualization game. The actualization game then displays in some interesting and exciting fashion the game's outcome that was concealed in the Destiny Code. The on-line system can store Destiny Codes and not allow the codes to be played twice.

The Player will now take the game medium to a redemption center and claim the actual prize, if any, at block 51.

Figure 7:
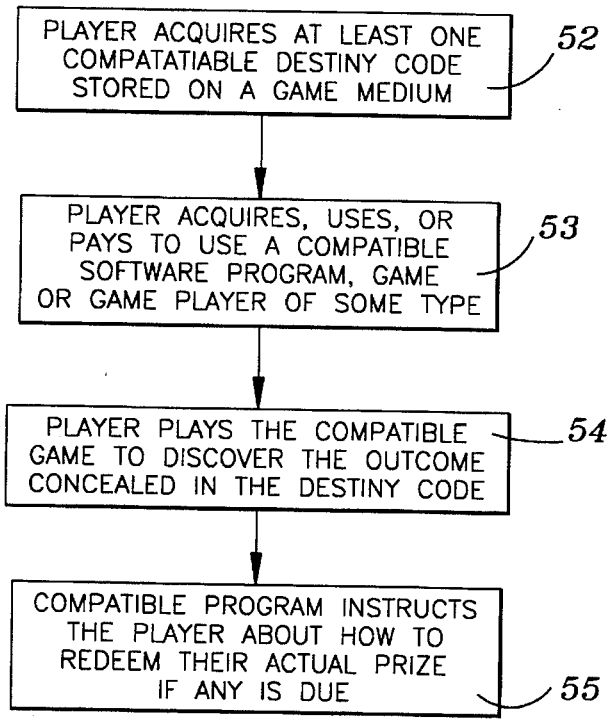
FIG. 7 illustrates a block diagram of a compatible system for use with the present game.

Referring to FIG. 7, a block diagram of a further embodiment of the present system is illustrated. Players acquire at least one Destiny Code that is made compatible with the present software, and is stored on a game medium at block 52.

The player now acquires a compatible game at block 53. Any compatible game will be able to determine the outcome of any compatible Destiny Code. Since only the outcome of the game is stored in the Destiny Code, and not the way in which the game should be played or its rules, many different types of compatible games will be developed to appeal to many different likes and interests.

Playing the compatible game allows the player to discover the outcome of the compatible Destiny Code at block 54.

The compatible game will then instruct the player about how to claim the actual prize, if any is due, at block 55.

Referring to FIGS. 8–13, software flow charts are illustrated for the present game. The program begins at the start block 110 where the player starts the program. The program will run as a stair computer program. The program is loaded into memory, and will set up program variables and display a "welcome" screen.

The system will request at least one Destiny Code from the player at block 112. In order for the player to access this program, the player will be required to enter a Destiny Code. This Destiny Code is be stored in a separate location. The Destiny Code, for example, can be located on a plastic piece that is attached to the floppy diskette or CD ROM which stores the program. The plastic piece, in order for the disk to be used, must be broken off. Once the plastic piece is broken off, the piece can be opened like a book to reveal the Destiny Code.

The Destiny Code includes encoded control information for security purposes, such as, for example manufacturers code, lot number, game type, version number of the game and other information. Program information includes whether the Destiny Code is a winner or a loser; the amount of money that the Destiny Code wins; the minimum prize for this game; the maximum prize for this game; and related game details. This Destiny Code will be the actual number that can be entered at a redemption site to indicate whether or not the Game Medium contains a winning game, independent of whether or not the game is played. The Destiny Code is the control number that is kept separate and physically off the disk.

At block 112, the Destiny Code is requested. There will be a check at block 114 to see if that Destiny Code is valid. If there is a missing number or if the number is not within the range of valid numbers then the program will go back and request the number again. This loop can be expanded by adding a feature that after a certain number of entries of the Destiny Code the diskette is wiped clean so that if a player is just trying to find out which Destiny Codes win and lose they will be thwarted.

If the Destiny Code is valid, the program will then read a history file at block 116. In this history file will be information as to the number of times the Game Medium was played, information about how many times this particular player has played, information about different habits that this player has during play, and general information as to what has transpired during the game. The serial numbers from the computer's BIOS from the different computers that the Game Medium was used will be stored so when a winner comes to claim a prize, the gaming authorities could process that disk and see how many different computers the disk was played on and then check for fraud. The history file will be used to check for security. The history file can also be used for the player to display their wins and losses so the player can keep track for tax purposes.

Block 118 is a decision block identified as "game encrypted because lotto was played". To increase sales, a lottery operator may wish to have the games run only once. If this is the case after the lotto game is played the Game Medium is rendered unusable through encryption. The status of the game at that point is checked. If the game is a winner, a screen will be displayed that shows it is a winner. If the game is a loser, the final results will be displayed and the player cannot play that game again. This is a security measure. If the game has been encrypted, then the program will display an error at block 120 along with the final status of the game. The game cannot be played anymore and the program exits at block 122. If the game has not been encrypted, that means that this is the first time the game has been played or the game has not been completed.

Block 124 displays the "Introduction Screen Directions, Video Music And Credits". This would be the main welcome screen. At this point the program will display information, including, for example, a video describing the different games that are available. The video may include scenes of the old west or a space theme. If the game is a puzzle, elements of the puzzle would be described. The program will wait for a key to be pressed or some button to be pressed at block 126. As soon as the key is pressed, the program proceeds to block 128 to display the main Game Menu and to allow for game selection. The menu could be in the form of a picture of a street, a horse track and race field, a casino, and a lottery redemption center. Games including horses, block 130; Play 21, block 134; and Play Lotto, block 132, are for illustration purposes and are just examples of a few types of games that can be used with the present invention.

At this point in the game, the player can be really brought into the game. Displays can illustrate a city with a road map or the actual visuals that the player can click to get to different places. The player can play the game like an interactive adventure game. The ultimate extreme allows the player to actually play the game and get involved in the game. If the game is a murder mystery of some type, the player may find clues and then play Sherlock Holmes. And once the player solves the crime the player would win Fictitious Awards that allow him to gain additional Fictitious chances for the lotto drawing at the end of this game.

Figure 8:
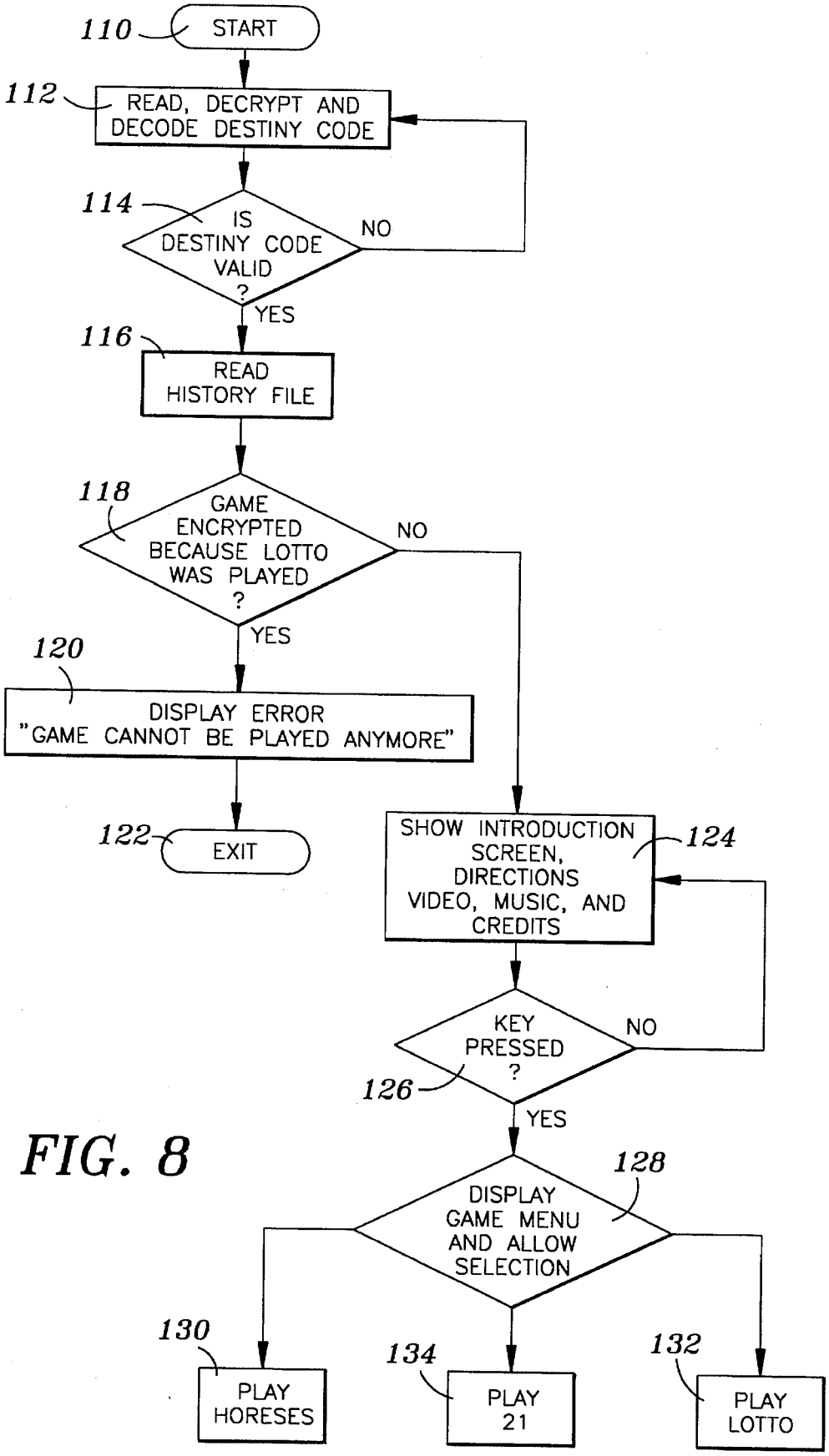
FIGS. 8–13 are computer flow diagrams illustrating the present software.
Figure 9:
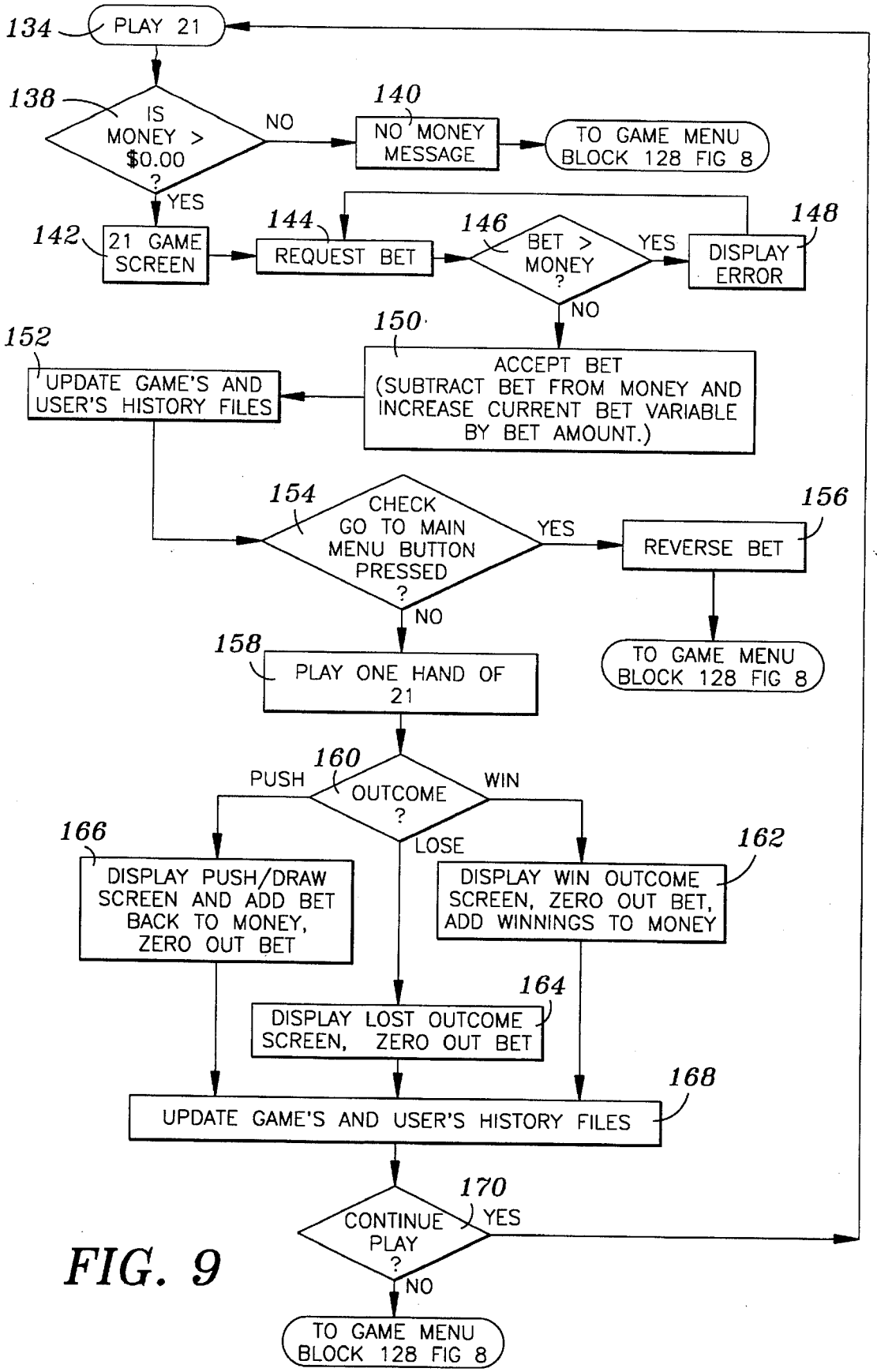

Referring to FIG. 9, if the player selects the Play 21 game, block 134 (FIG. 8), the program will check at block 138 to see if the player has money. If the player has more than zero dollars, then the player can continue with the game. If the player does not have any money, the program will display a no money message at block 140 and the player will go back to the display game menu, block 128 (FIG. 8).

If the player has more than zero dollars, the 21 game screen is displayed at block 142. The 21 game screen can display a dealer, in progress with a person watching as in a casino in the year 1995 or if the game is based on an old west casino theme, the display could include music playing in the background, and girls dancing on a stage with a dirty old cowboy dealing.

After the 21 Game screen is displayed, the program requests a bet at block 144. The player places a wager. At block 146, a decision is made; if the bet is greater than the money the player has, an error is displayed at block 148 and another bet is requested. If the bet is less than the money that the player has, the bet is accepted at block 150, and an operation performed to subtract the bet amount from the money variable (the money the player has) and to increase the bet variable by the bet amount. For example, if the player has $10 in his money variable, and he makes a $5 bet, the bet variable would increase by $5 and the money would decrease from $10 to $5.

At block 152, the system and player history files are updated. The history file is a detailed security file. The player's history file will have information about playing statistics; for example, how many hands the player won and how many hands the player lost. The game's history file will have more detailed information for instance, if the program was terminated by a debugging program or modified by some type of nonstandard means and it will keep track of these incidences to help ferret out fraud.

At block 154, a decision is made to determine if the main menu button was pressed. The player might begin a hand and then decide that before the hand is dealt that he wants to go back to the main menu. If the player gets to that point and places the bet, the player can click the "Go To Main Menu" button at the bottom of the screen. At that point the program will reverse his bet block 156, for example, take $5 out of the bet variable and add it to the money variable. This will return the program back to block 128 (FIG. 8).

If the player did not press the "Go To Main Menu" button block 154 he will then play one hand of 21 at block 158. The program can flow as follows. The program deals cards. The house will be the computer in this game. The player will play against the computer.

If the outcome at block 160 is that the player won, then the winnings get added to the money variable at block 162, so if the player's hand is a 10 and a Jack, and the dealer has a 10 and a 7 the player wins. The $10 winnings would be added to the money variable and the bet variable would be zeroed out.

If the player loses at block 164, then the bet variable is zeroed out and the house's winnings are increase by $5. If the hand results in a push at block 166, meaning that both the player and the house had the same hand and the dealer could not take another card, for example both have a 10 and an 8, then the bet is added back to the players money account and no gain or loss is incurred.

The history file is updated at block 168. The player can then decide to continue play at block 170 or return to the main menu, block 128 (FIG. 8).

Figure 10:
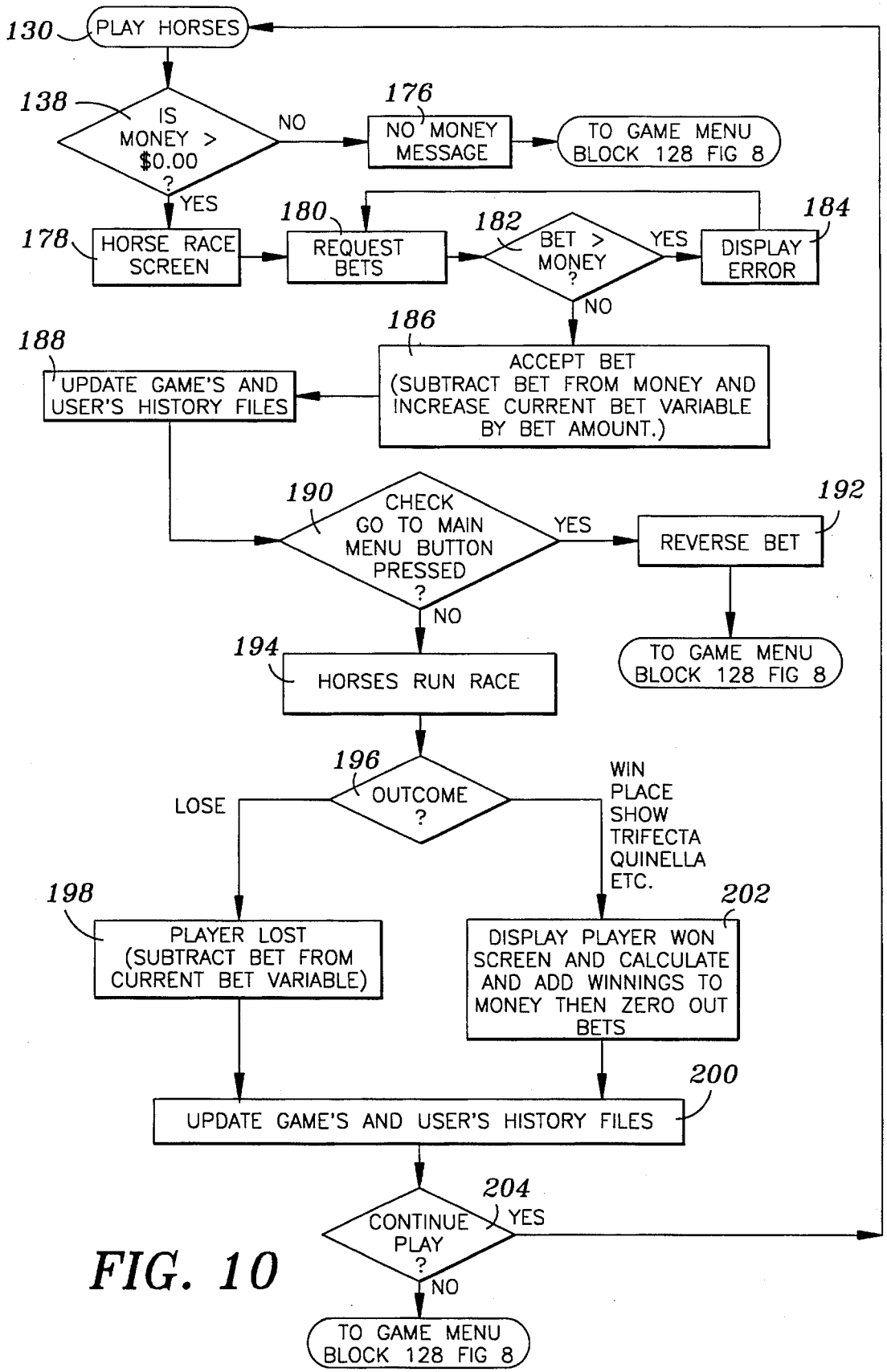

Referring to FIG. 10, the program for the play horses block 130 (FIG. 8) is illustrated. At block 174, the system checks to see if the player has more money than zero dollars.

If the money variable is not greater than zero, block 176 displays a message and the player continues to the game menu block 128 (FIG. 8). If the player's money variable is greater than zero the Horse Race screen is displayed at block 178 and a bet is requested at block 180. If the bet is greater than the money available, determined at block 182, an error will be displayed at block 184 and another bet will be requested. If the bet is not greater than the money available, the bet will be accepted at block 186 and then subtracted from the money variable and then added to the bet variable. If the player has $100 and bets $10 on horse #2, the amount bet on horse #2 is increased by $10.

The history file and the player's history file are updated at block 188.

At block 190, the "Go To Main Menu" button status is checked. If the button is pressed, the bet will be reversed at block 192 and the player will return to the game menu at block 128 (FIG. 8).

If the main menu button is not pressed, the horse race is run at block 194 and the outcome is displayed at block 196. The display of the race at block 194 can show actual video of horses or a computer animated screen. The player could even play a jockey and run the race.

If the player loses, the bet is subtracted at block 198 and the game's history file and the player's history file are updated at block 200. If the player wins, the winnings are calculated at block 202. At block 204, the player can continue play or return to game menu block 128 (FIG. 8).

Figure 11:
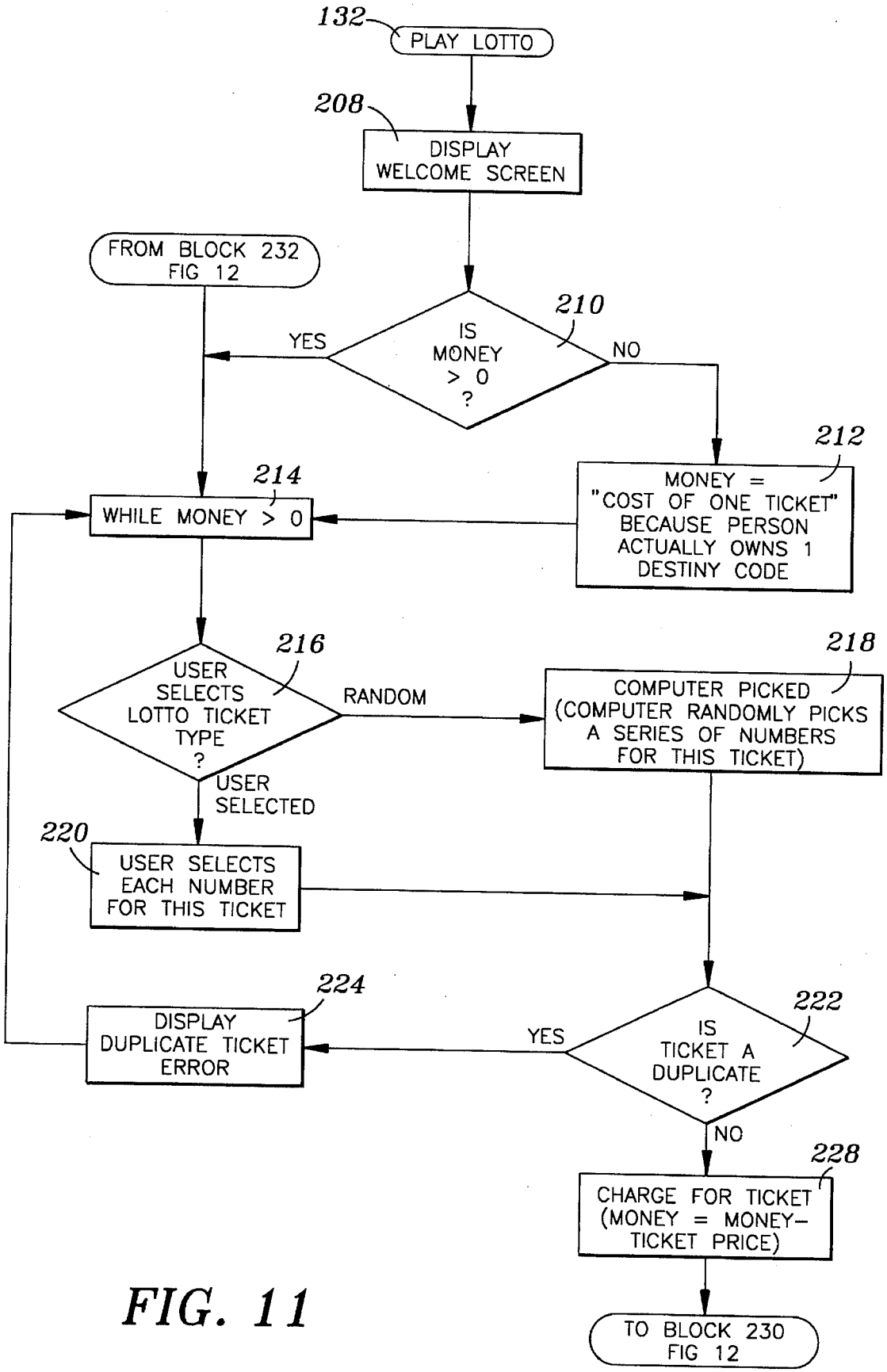
Figure 12:
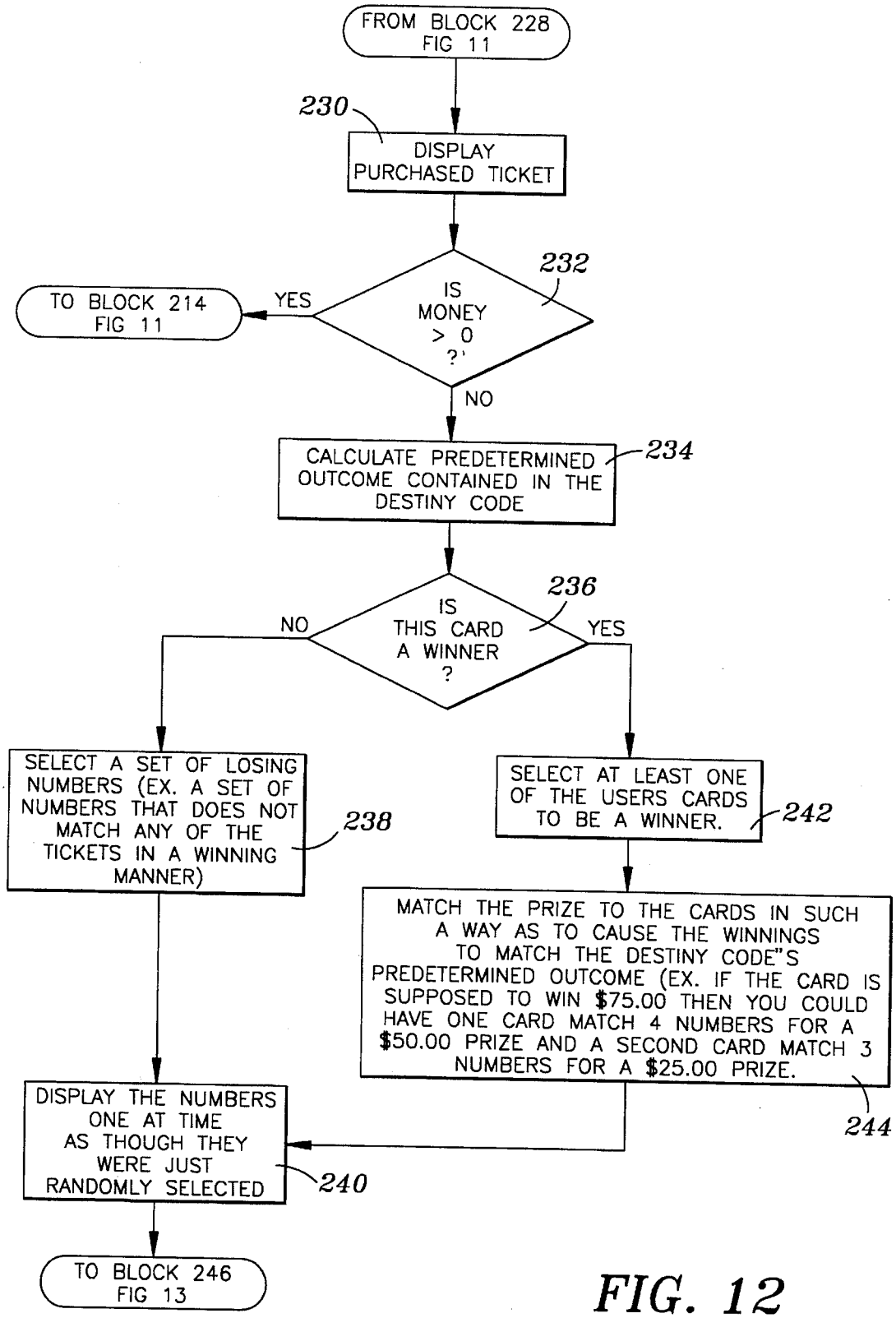
Figure 13:
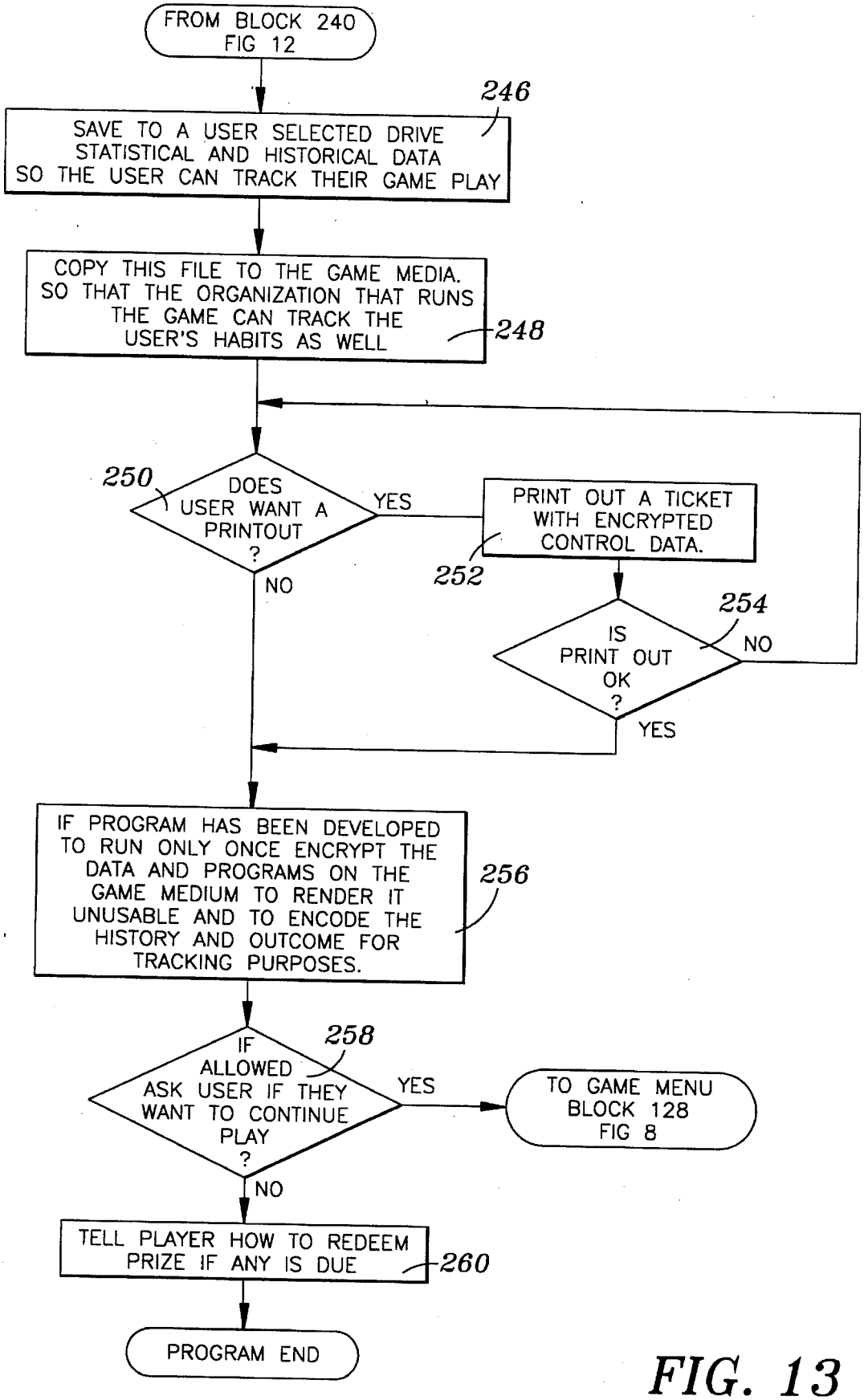

Referring simultaneously to FIGS. 11, 12, and 13, a third game, Play Lotto, block 132 (FIG. 8), is illustrated for use with the present invention. A welcome screen is displayed at block 208. The system checks to see if the player's money variable contains greater than zero dollars at block 210. If the money variable does not contain more than the price of a single lotto ticket, the system will give the player the price of a single lotto ticket or any predetermined amount at block 212.

At block 214, the system checks to determine if the money variable is greater than zero to determine if the purchase of more lotto tickets is possible. There are methods in which you can purchase lottery tickets. At decision block 216, the player selects either a random pick ticket, in which the computer selects at block 218 all of the lotto numbers for the player or the player can select numbers at block 220.

At block 222, a check is made to determine if this ticket is a duplicate. If the ticket is a duplicate, a duplicate ticket error is displayed at block 224 and the program returns to block 214. For the random ticket, if a duplicate ticket is determined the computer re-selects a number until no duplicate is selected. If this ticket is not a duplicate at block 228, a charge for the ticket is made by decreasing the money variable by the cost of the ticket.

Referring to FIG. 12, the system will then display the purchased ticket at block 230. A decision is made at block 232 to determine if money variable contains more than zero dollars. If the money variable does, the program returns to block 214 (FIG. 11) and the program continues purchasing tickets until the player has used all dollars in the money variable.

The program calculates its predetermined outcome at block 234 using the Destiny Code that has already been decrypted and decoded at block 112 (FIG. 8). The outcome may be determined, for example, by comparing the Destiny Code to a lookup table to determine if the number is a loser or a winner and the size of the prize if any. For example, if the series of digits in the Destiny Code indicates that the game is a $75 winner, then the system will set up a winning lotto drawing.

The decision is made at block 236. If the card is not a winner, then the computer will randomly select a set of losing numbers at block 238. The computer will select a set of numbers randomly, and then check to see if any of the cards match that set of numbers in a winning manner. If none of the cards match in a winning manner, that set of numbers will be displayed at block 240 in an exciting and interesting lotto like display. The set of numbers could be displayed by spinning a wheel or by picking a ball from an air filled Lucite cage. This will give the appearance of randomness even though the outcome was predetermined at the time the Destiny Code was created.

If this card is a winner, then the system will select at least one of the lottery tickets to be the winner at block 242.

At block 244, the system will take into consideration the pay-out schedules when making the winning number selection. For example, if the Destiny Code contains is a $75 winner, the computer can let one lotto ticket win $75 or 3 lotto tickets win $25 each, if the player has three lotto tickets. This is the main reason for not allowing duplicate tickets. If a player had $11, and selected 11 of the same tickets and this card was a winner, there might not be a pleasing way to award a $75 prize out of 11 different tickets that have the same sequence of numbers on them. The reason that a player is given one ticket, is because if the card is a winner the program must have at least one lotto ticket to show the outcome of the Destiny Code. Block 240 now displays the numbers one at a time as though they were just randomly selected.

Referring to FIG. 13, at block 246, the program saves the player's statistical and historical data, to a player selected location so the player can track his game play. At block 248, this file is copied to the game medium so that the organization that runs the game can track the player's habits as well.

A standard format can be used, for example, on the player's computer, one PC file can track the history of every game played. This file can be copied to the game medium to develop a complete historical makeup of the different things that this player has been doing and this information can be used for marketing and security purposes.

Block 250 allows the player to print out the results of the game and other statistics. If a printout is desired, at block 252 a ticket with encrypted control data is printed. Inquiry is made at block 254 to ensure the ticket has printed properly. If the game is designed to run only once, the game medium is encrypted at block 256. At block 258, a decision by the player is made to end the game or return to the game menu, block 128 (FIG. 8).

If the player decides to end game, a screen will be displayed that tells the player how to redeem his prize, if any is due.

Game medium is brought to a redemption center. The redemption center processes the Destiny Code and awards any prizes that are due.

Whereas the present invention has been described with respect to specific embodiments thereof, it will be understood that various changes and modifications will be suggested to one skilled in the art and it is intended to encompass such changes and modifications as fall within the scope of the appended claims.

claim:

1. A method for playing a player lottery game comprising the step of: acquiring by a player a game piece, the gaming piece including a code which includes data indicating whether the player wins or loses the lottery game and an amusement game, the data being unrecognizable to the player, such that the player does not know whether the player will win or lose the game prior to play of the amusement game;

entering the code by the player into a processor prior to amusement game play;

the processor generating the amusement game on a display for play by the player, the player controlling game play by inputting game parameters to the processor;

the processor controlling whether the player will win or lose the amusement game based upon the code entered by the player; and providing on a display an indication to the player of the amusement game win or loss based upon the code.

2. The method of claim 1 wherein the gaming piece includes magnetic media for storing the code.

3. The method of claim 1 wherein the gaming piece includes laser optical media for storing the code.

4. The method of claim 1 wherein the gaming piece includes paper media for storing the code.

5. The method of claim 1 wherein the amusement game includes a horse race.

6. The method of claim 1 wherein the amusement game includes a card game.

7. The method of claim 1 wherein the step of providing to the player of the game an indication of a game win or game loss includes the steps of:

selecting by the player a series of random numbers;

generating a series of numbers by the processor; and indicating a game win by at least one of the processor generated numbers matching at least one of the player selected numbers.

8. The method of claim 1 wherein the step of entering the code into a processor includes a processor within a computing device.

9. The method of claim 1 wherein the step of entering the code into a processor includes a processor within an on-line subscription service.

10. A lottery type game comprising:

a gaming piece, said gaming piece including a code which includes data indicating whether a player wins or loses the lottery game and an amusement game, said data being unrecognizable to the player, such that the player does not know whether the player will win or lose the games prior to play of the amusement game;

a processor for receiving said code input by the player prior to amusement game play;

said processor generating the amusement game on a display for play by the player, said processor determining whether the player will win or lose the amusement game based upon said code; and a display for providing an indication to the player of the amusement game win or loss based upon said code.

11. The lottery type game of claim 10 wherein said gaming piece includes magnetic media for storing said code.

12. The lottery type game of claim 10 wherein said gaming piece includes laser optical media for storing said code.

13. The lottery type game of claim 10 wherein said gaming piece includes a paper media for storing said code.

14. The lottery type game of claim 10 wherein said amusement game includes a horse race.

15. The lottery type game of claim 10 wherein said amusement game includes a card game.

16. The lottery type game of claim 10 wherein said processor includes a computing device.

17. The lottery type game of claim 10 wherein said processor includes a processor within an on-line subscription service.

* * * * *